US009371180B2

(12) United States Patent
Corbitt

(10) Patent No.: US 9,371,180 B2
(45) Date of Patent: Jun. 21, 2016

(54) SYSTEM AND METHOD FOR SECURING A LINER WITHIN A CONTAINER

(71) Applicant: Lee Wayne Corbitt, Ormond Beach, FL (US)

(72) Inventor: Lee Wayne Corbitt, Ormond Beach, FL (US)

( * ) Notice: Subject to any disclaimer, the term of this patent is extended or adjusted under 35 U.S.C. 154(b) by 0 days.

(21) Appl. No.: 14/294,723

(22) Filed: Jun. 3, 2014

(65) Prior Publication Data

US 2015/0060460 A1 Mar. 5, 2015

Related U.S. Application Data

(60) Provisional application No. 61/870,833, filed on Aug. 28, 2013.

(51) Int. Cl.

| | |
|---|---|
| ***B65F 1/06*** | (2006.01) |
| *B65F 1/00* | (2006.01) |
| *B65F 1/02* | (2006.01) |

(52) U.S. Cl.

CPC ..... *B65F 1/06* (2013.01); *B65F 1/0006* (2013.01); *B65F 1/02* (2013.01); *B65F 2001/061* (2013.01)

(58) Field of Classification Search

CPC ..... B65F 1/06; B65F 1/062; B65F 2210/181; B65F 1/0006; B65F 1/02; B65F 1/08; B65F 2001/061; B65F 1/65; Y10S 206/813; A47K 11/00; A47K 13/00

USPC ..... 220/495.08, 495.07, 495.11, 908.1; 206/813; D34/10; 29/248

See application file for complete search history.

(56) References Cited

U.S. PATENT DOCUMENTS

| | | | | | |
|---|---|---|---|---|---|
| 1,343,955 | A * | 6/1920 | Baker | 220/320 |
| 3,050,319 | A * | 8/1962 | Colby | 277/378 |
| 3,893,649 | A * | 7/1975 | Cornell et al. | 248/99 |
| 4,267,928 | A * | 5/1981 | Curry, Jr. | 206/583 |
| 4,715,572 | A * | 12/1987 | Robbins et al. | 248/101 |
| 4,951,903 | A | 8/1990 | Frey | |
| 5,671,861 | A | 9/1997 | Hall et al. | |
| 5,950,251 | A * | 9/1999 | Cost et al. | 4/483 |
| 7,828,168 | B2 * | 11/2010 | Gagnebin | 220/495.04 |
| 2006/0283852 | A1 * | 12/2006 | Greiner | 220/4.22 |
| 2008/0000911 | A1 * | 1/2008 | Bailey | 220/495.07 |

* cited by examiner

*Primary Examiner* — Anthony Stashick
*Assistant Examiner* — James M Van Buskirk
(74) *Attorney, Agent, or Firm* — Terry M. Sanks, Esq.; Beusse Wolter Sanks & Maire, PLLC

(57) ABSTRACT

An apparatus including a liner ring, configured with a wall, to fit within the container so that the liner ring remains in place at a defined distance within the container based on a dimension of the container and a dimension of the liner ring, and a sealant attached to an outer surface of the liner ring configured to contact an inner surface of the container and form a seal is disclosed. Arrangement of a liner with an opening having ends being placed around the liner ring provides for the ends to the opening of the liner being located between the ring liner and container within the container. A system and method are also disclosed.

18 Claims, 6 Drawing Sheets

SYSTEM AND METHOD FOR SECURING A LINER WITHIN A CONTAINER

CROSS-REFERENCE TO RELATED APPLICATIONS

This application claims the benefit of U.S. Provisional Application No. 61/870,833 filed Aug. 28, 2013, incorporated herein by reference in their entirety.

BACKGROUND

Embodiments relate to containers and, more particularly to, a securing a liner within a container.

To maintain cleanliness of such containers as trash cans, liners are usually placed within the trash can where edges of an opening to the liner are wrapped over a top edge of the container. In some cases, the liner is sized to that it is able to remain in place by simply folding the edges of the opening over a top edge of the container. In other cases, the liner may have to be tied to itself, such as, but not limited to, tying a knot in a part of the material of the liner near the opening to ensure that the liner is taunt enough against the container to prevent the liner from falling within the trash bin. In yet other cases, rubber bands have been placed around outer circumference of a trash bin and over the edge or flap of the liner to help secure the liner in place. However, rubber bands are known to break if expanded too far or too often. Furthermore, rubber bands for larger trash cans are harder to manually use either due to the elasticity of the band or its overall size.

Placement of the liner results in the liner being visible on the outside of the trash bin when viewed from the side. Therefore, if the trash bin has any ornament aspects to it, the opening of the liner extending over the side of the trash bin makes it impossible to see the ornamental design when the liner is in place.

Users of container, such as, but not limited to, trash bins would benefit from being able to better secure a liner within the container, especially when waste material is placed within the container.

SUMMARY

Embodiments relate to an apparatus, system and method for securing a liner within a container. The apparatus comprises a liner ring, configured with a wall, to fit within the container so that the liner ring remains in place at a defined distance within the container based on a dimension of the container and a dimension of the liner ring. The apparatus further comprises a sealant attached to an outer surface of the liner ring configured to contact an inner surface of the container and form a seal. Arrangement of a liner with an opening having ends being placed around the liner ring provides for the ends to the opening of the liner being located between the ring liner and container within the container.

The method comprises arranging a liner bag through a liner ring, having an approximately vertical wall, with ends to an opening of the liner bag wrapped around the liner ring and pressing the liner ring into an opening of a container, the liner ring configured to engage the container by way of a gasket secured to the approximately vertical wall, down to a depth where a top edge of the liner ring is substantially parallel with a top edge of the container, wherein the liner ring is secured within the container to prevent the liner bag from disengaging the liner ring when material is placed within the liner bag.

The system comprises a container, a unitary liner ring, configured to secure a liner to the container, and a sealant attached to a surface of the liner ring configured to contact a surface of the container and form a seal.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1A:
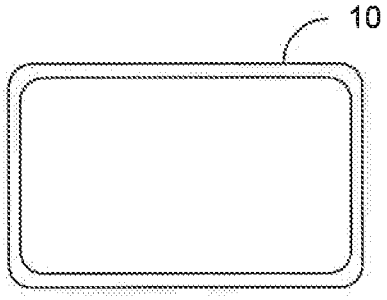
FIGS. 1A and 1B show a top view of a liner ring with different shapes.

Embodiments are described herein with reference to the attached figures, wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Figure 1B:
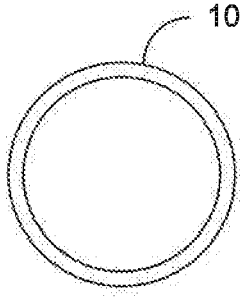

FIGS. 1A and 1B show a top view of a liner ring having two shapes. As illustrated, the liner ring 10 may comprise any plurality of shapes where the shape is provided to confirm to an opening shape of a container 20 (shown in FIG. 2). Thus the shape of the container 20 may be round (as illustrated in FIG. 1A), oval, rectangular (as illustrated in FIG. 1B), square, etc., and the liner ring 10 may have a compatible shape container to container 20. The type of container 20 the liner ring 10 may function with is any container 20 which may have a liner placed within it, such as, but not limited to, a trash or waste can with a trash bag as a liner, an ice bucket with a bag as a liner, bio-hazard containers with a bio-hazard bag, animal litter boxes and litter bags, etc. As illustrated in FIGS. 2, 3, 5 and 7, the container 20 may be any device which has a sidewall with a first end defining an opening. The sidewall may have an inner surface 13 and an outer surface. A base 17 is attached to the sidewall at or near a second end of the sidewall that is distant from the opening. The liner ring 10 may be constructed from metal or any other material, but plastic was found by the inventor to provide such advantages as lighter weight and being non-corrosive.

Figure 2:
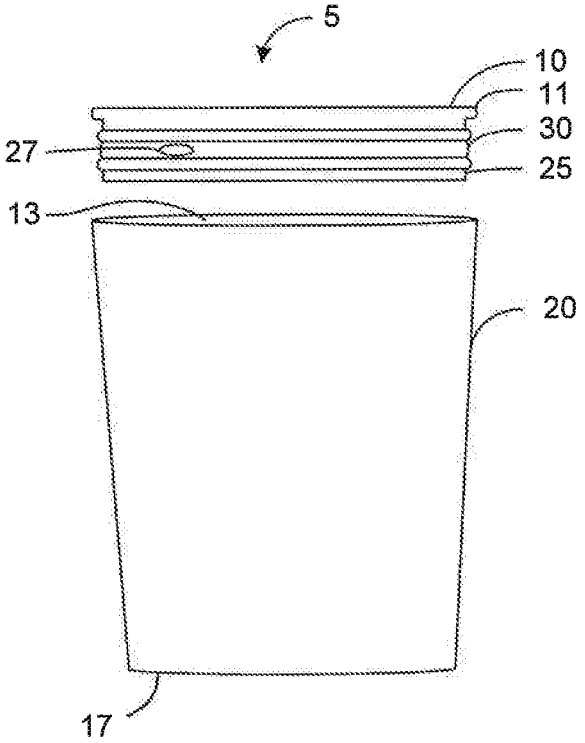
FIG. 2 shows a side view of the liner ring before being pressed into a container.

FIG. 2 shows a side view of the liner ring engaging a container. As illustrated, a gasket 30, gasket material, sealant or sealant material, typically made of a pliable material such as, but not limited to, rubber or vinyl, is located on a side of the liner ring 10. As a non-limiting example, the gasket 30, or sealant, may be a compression gasket. As illustrated, the liner ring 10 comprises a wall 25, which may be construed as a vertical, nearly vertical, or approximately vertical. The terms "nearly" and "approximately" are used herein to refer to the wall not being exactly vertical since a low of a container may not be exactly vertical and the liner ring 10 may have a similar angle or slope. The wall 25 may comprise openings 27, at least one opening, through the wall 25. The openings 27 are provided to release air that becomes trapped between the container 20 and a liner 40. Thus, without the openings 27, the liner 40 may balloon into an opening within the container 20 when the liner ring 10 is put into place with the liner 40 attached.

The gasket 30 may be adhered to the liner ring 10 with an adhesive or the liner ring 10 and gasket 30 may be configured so that the gasket 30 slides or is fitted into a groove in the liner ring 10. A depth of the liner ring 10, going into the container 20, is not critical and may range in height. In an embodiment, the ring 10 may be sized to the inside measurements of the container 20 at the top edge of the container 20 minus clearance for the container 20 to receive the liner ring 10 with the gasket 30 as it is pressed in or inserted into the container 20. In an embodiment, the wall 25 of the liner ring 10 may comprise an upper lip 11 that is configured to rest upon a part of a top edge of the container 20. In an embodiment, a top edge of the liner ring 10 is nearly parallel to the top edge of the container 20 when the liner ring 10 is placed into the container 20. "Nearly parallel" is used to mean that less than 2 to 3 millimeters separate a height of the top edge of the liner ring 10 from the top edge of the container 20.

Thickness of the material that comprises the liner ring may also vary as well within meeting the intent of providing a ring 10 which fits within the container 20 to secure the liner 40. The inventor constructed models of the liner ring which ranged in thickness from 4 to 4.5 millimeters. The gasket 30 may be provided to assist in holding the liner ring 10 in place when inserted within the container 20 and to assist in holding a liner 40 in place when the liner 40 and liner ring 10 are within the container 20.

Figure 3:
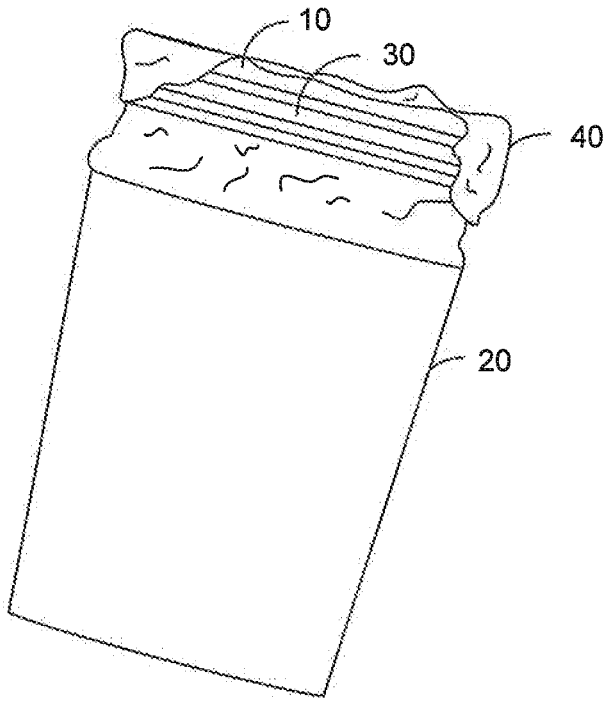
FIG. 3 shows a liner being placed around a liner ring within a container.

FIG. 3 shows a liner being placed around a liner ring within a container. As illustrated, a liner bag, or liner, is wrapped around the liner ring. The liner ring may work with a plurality of bags or liners, including ones with tie or pull strings. Though most waste containers are wider at the top and taper downward thus preventing the ring from falling too tar into the container, the ring comprises a rim that rests at or near the top edge of the container which assist in positioning the container ring properly. In another embodiment, the rim may be configured to be more firmly affixed to the container, such as, but not limited to, having a snapping configuration between the liner ring and container.

Figure 4:
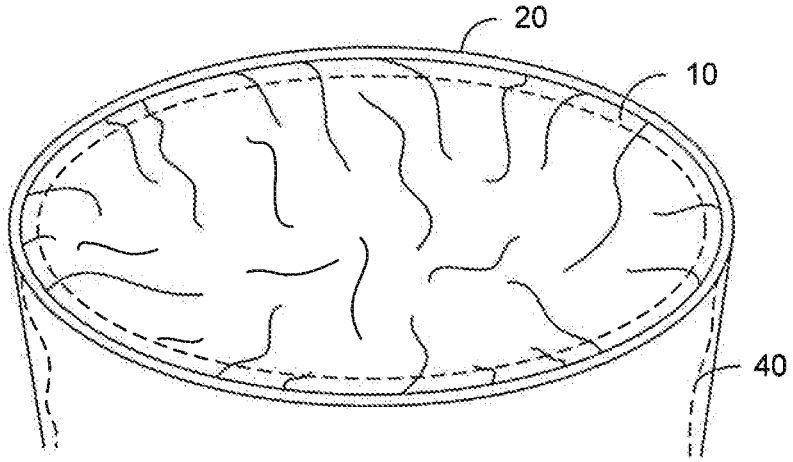
FIG. 4 shows the container with a liner in place using the liner ring.

FIG. 4 shows a container with a liner 40 in place using the liner ring 10. From a top view, a top edge of the container 20 is visible. The liner ring 10 is not visible as it is covered by the liner 40. Because of the seal formed between the liner ring 10 and the inner surface of the container 20, as debris is placed into the liner 40, the liner will not slip from being wrapped or placed around the liner ring 10.

Figure 5:
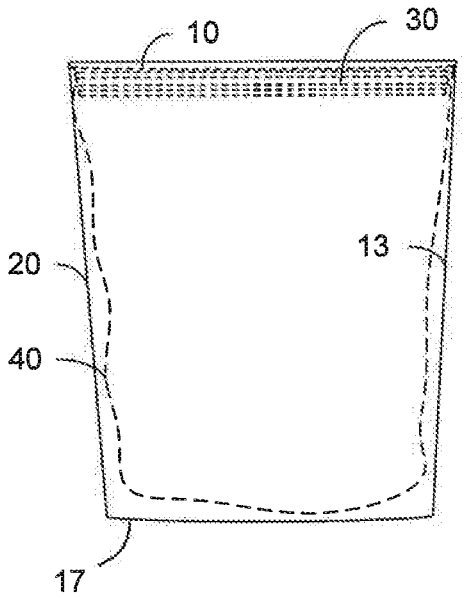
FIG. 5 shows a side view of the container in FIG. 4 with the liner not visible on a side of the container because of use of the liner ring.

FIG. 5 shows a side view of the container in FIG. 4 with the liner not visible on a side of the container because of use of the liner ring. As illustrated, the ends of the bag are within the container. Since the ends of the bag are firmly held in place by the gasket up against an inner surface of the gasket, chances of the bag falling into the container is significantly reduced, regardless of how heavy the material which is placed within the bag while in the container. The use of the liner ring does not result in snagging or perforating of the liner by any attachments which may be provided to hold the liner bag in place. Furthermore, when placing the liner bag within the container, any need to tie off an end of the liner bag is no longer needed.

As disclosed above, the system 5 may comprise the container 20. The liner ring 10 may provide that is configured with a wall 25, outer surface or downward extending surface, that extends downward from the lip 11, where the liner ring 20 may fit within the container 20 so that the liner ring 10 remains in place at a defined distance within the container 20 based on a dimension of the container 20 and a dimension of the liner ring 10. The gasket 30 may be attached to the outer surface 25 (or wall) of the liner ring 10 and may be configured to contact an inner surface 13 of the container 20 and form a seal. An arrangement of the liner 40 with an opening having ends being placed around the liner ring 10 may provide for the ends to the opening of the liner bag being located between the ring liner 10 and container 20 within the container 20.

Figure 6:
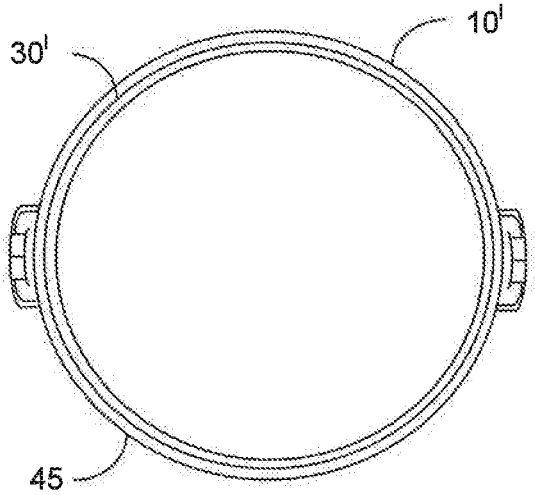
FIG. 6 shows an embodiment of liner ring that fits an outer circumference of a container.

FIG. 6 shows another embodiment of a liner ring. This liner ring 10' may be used where the ring secures the liner 40 on an outside surface of the container 20. The liner ring 10' may be considered as having a lip 45. The sealant 30 may be attached to the wall of the liner ring 10' facing the container 20 when the liner ring 10' is in place. In other words, the lip of the liner ring 10' may have the gasket 30 on an inner surface. The liner ring 10' may be configured to fit around an outer circumference of the container 20. The sealant 30 may be attached to an inner surface of the liner ring 10' and configured to contact the outer surface of the container 20 to form the seal.

Figure 7:
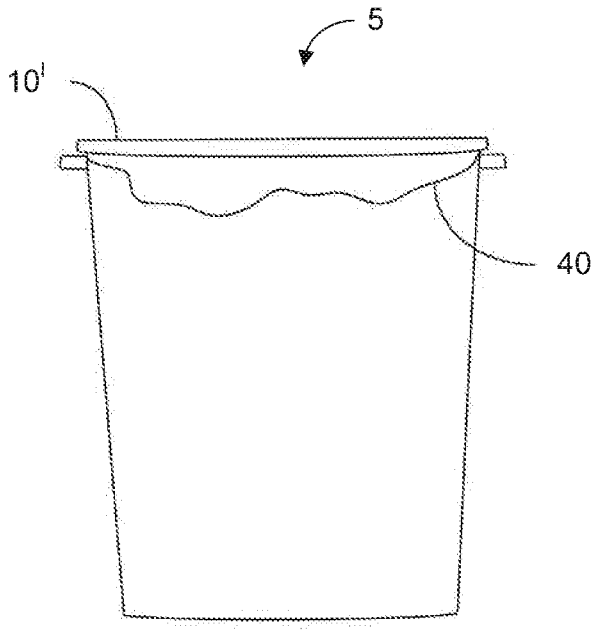
FIG. 7 shows and embodiment of a liner ring mounted outside of a circumference of a container.

FIG. 7 shows another embodiment of a liner ring mounted outside of a circumference of a container. After the liner 40 is placed within the container 20, the liner ring 10' is attached to the top of the container 20 wherein the gasket 30 holds the liner 40 in place. As illustrated, the opening to the liner 40 is visible on the side of the container 20 once the liner 40 and liner ring 10 are in place. In this embodiment, the opening in the liner ring 10' may provide for a top cover which nearly covers a partial part of the container opening. As a non-limiting example, if the container 20 is a recycling container for soda cans, the liner ring 10' may comprise a cover with an opening sufficiently sized to receive soda cans.

The liner ring 10, 10' in each embodiment may be a unitary piece, meaning that a single ring is used as opposed to two or more rings. The sealant 30, or gasket, is then attached to the unitary liner ring 10, 10'. The sealant is configured to further support the liner ring 10, 10' from being easily removed from within a container 20.

Figure 8:
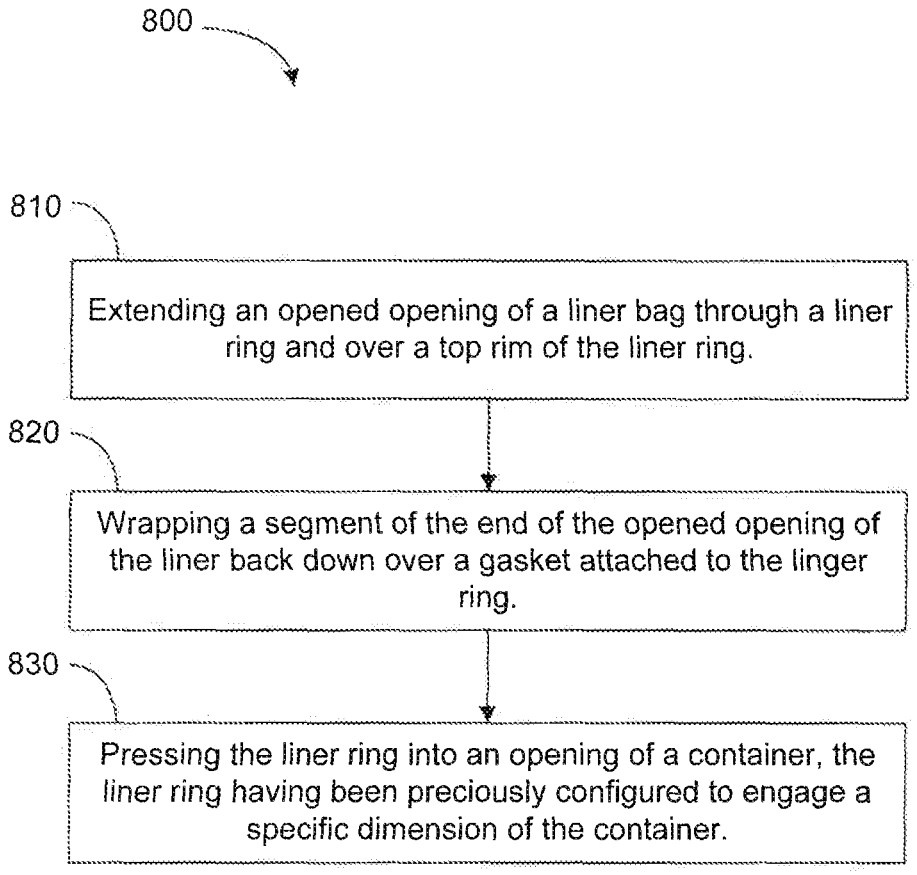
FIG. 8 shows a flowchart of an embodiment of a method securing a liner within a container.

FIG. 8 shows a flowchart of an embodiment of a method for securing a liner within a container. The method 800 comprises extends an opened opening of a liner bag through a liner ring and over a top rim of the liner ring, at 810. The method further comprises wrapping a segment of the end of the opened opening of the liner back down over a gasket attached to the linger ring, at 820. The method 800 further comprises pressing the liner ring into an opening of a container, the liner ring having been previously configured to engage a specific dimension of the container, at 830.

Figure 9:
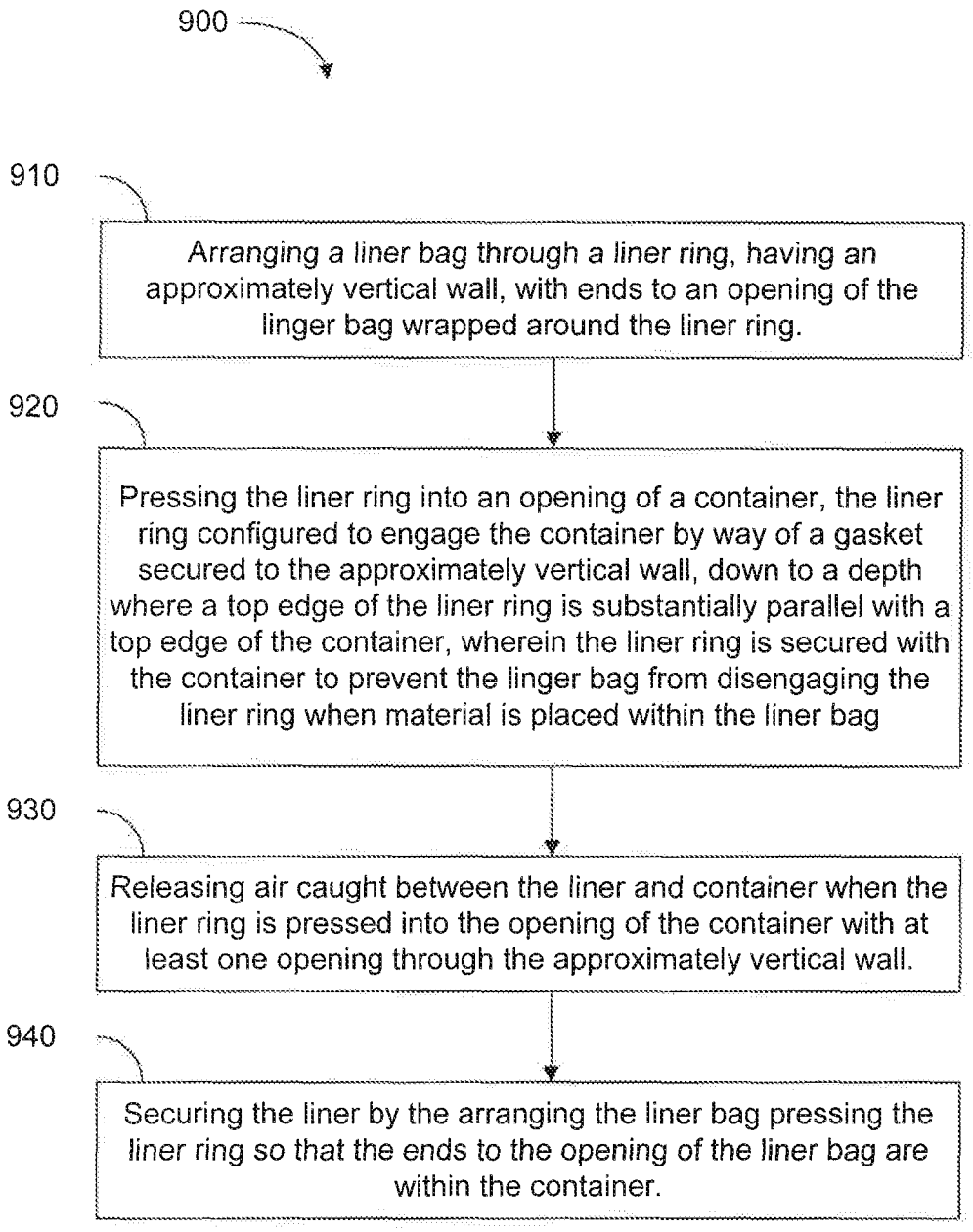
FIG. 9 shows another flowchart of an embodiment of a method.

FIG. 9 shows another flowchart of an embodiment of a method. The method 900 comprises arranging a liner bag through a liner ring, having an approximately vertical wall, with ends to an opening of the liner bag wrapped around the liner ring, at 910. The method also comprises pressing the liner ring into an opening of a container, the liner ring configured to engage the container by way of a gasket secured to the approximately vertical wall, down to a depth where a top edge of the liner ring is substantially parallel with a top edge of the container, wherein the liner ring is secured within the container to prevent the liner bag from disengaging the liner ring when material is placed within the liner bag, at 920.

The method may further comprise releasing air caught between the liner and container when the liner ring is pressed into the opening of the container with ate least one opening through the approximately vertical wall, at 930. The method may also comprise securing the liner by the arranging the liner bag pressing the liner ring so that the ends to the opening of the liner bag are within the container, at 940. The order of the steps in the method is not limited to the order disclosed above. Therefore, any order may be applicable.

Thus, as illustrated, the device, liner ring and gasket material, may firmly hold a liner or bag in place within a container, where the container may be any specific shape and the liner ring is configured to accommodate the shape of the container. The liner ring and gasket material may hold the hag, or liner, in place and keeps the top opening of the bag open for easy loading where the gasket also assist is holding the liner ring in place within the container, such as by preventing it from sliding further into the container.

The liner ring with its gasket may be used with existing containers without modifying the existing containers or supplied in combination with new containers. With new containers, the liner ring and container may be configured to prevent the liner ring from becoming permanently separated from the container. As a non-limiting example, a mount may be provided.

Thus, the liner ring and gasket as illustrated in FIGS. 1-5 do not change an outside appearance of the container. The liner ring and gasket may be used with round or rectangular shaped containers; can be adapted to many sizes from small waste baskets to large waste containers; does not require extra hag material to stretch over a top of the container when using embodiments illustrated in FIGS. 1-5; can be used with covered containers or container with hinged lids. Furthermore, embodiments do not have barbs, hooks or cut-outs, etc., and may be configured so that no assembly by an end user is required. Furthermore, the containers do not require any special ledge or additional components in order for the liner ring and gasket to be used with the container.

As those skilled in the art will recognize, short development time is required and the liner ring and gasket may be rather quickly brought to the market; there would be low manufacturing cost; there would be minimal set up time and training for production; the liner ring and gasket may be light weight and packable for shipping; and may be produced to be durable and washable, including, but not limited to, dishwasher safe.

Other realizable benefits include the liner ring and gasket may be removed from a container and a liner without dirtying the user's hands and when properly used will not be dirtied either; can be adapted to existing container; can be sold as a separate part; does not damage or perforate liners; can be used with tie and drawstring bags; does not include unsightly straps or rubber bands which may become lost or stolen; and does not interfere with nesting containers for shipment.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Therefore, the breadth and scope of the subject matter provided herein should not be limited by any of the above explicitly described embodiments. Rather, the scope of the embodiments should be defined in accordance with the following claims and their equivalents.

The invention claimed is:

1. An apparatus to secure a liner within a container defined by a sidewall with an inner surface and a base, the apparatus comprising:

a liner ring, with a wall, to fit within the container so that the liner ring remains in place at a defined distance within the container based on a dimension of the container and a dimension of the liner ring; and a compression gasket attached to an outer surface of the wall of the liner ring to form a seal when a part of the liner is placed between the compression gasket and the inner surface of the container;

wherein arrangement of the liner with an opening having ends being placed around the liner ring provides for the ends to the opening of the liner being located between the liner ring and container within the container when the liner ring is fit within the container so that the liner ring is not visible.

2. The apparatus according to claim 1, wherein the compression gasket is permanently adhered to the outer surface of the wall by an adhesive between the compression gasket and the outer surface of the wall and wherein the compression gasket maintains the liner ring in place at the defined distance within the container and to further to secure the liner placed within container.

3. The apparatus according to claim 1, wherein ends of the opening to the liner are secured within the container by the liner ring to provide for the liner having the ends of the opening wrapped around the liner ring towards the compression gasket so that the opening is secured within the container when the liner ring and liner are placed within the container.

4. The apparatus according to claim 1, wherein the wall of the liner ring comprises at least one opening through the wall to provide for a release of trapped air between the container and the liner when the liner and liner ring are placed within the container.

5. The apparatus according to claim 1, wherein the liner ring comprises a top edge, wherein the wall is a vertical wall that extends to a bottom edge of the liner ring opposite to the top edge, and wherein when the liner ring is within the container, the top edge is substantially parallel to a top edge of the container.

6. The apparatus according to claim 1, wherein the liner ring comprises a lip from which the wall extends in a downward direction from the lip.

7. The apparatus according to claim 1, wherein the liner ring comprises a top edge with a first outer diameter and wherein the wall of the liner ring comprises a cylindrical wall with a second outer diameter less than the first outer diameter that terminates at a bottom edge of the liner ring opposite to the top edge and wherein the compression gasket is attached to the outer surface of the wall between the top edge and the bottom edge of the liner ring, wherein beyond where the wall of the liner ring terminates, the liner is adjacent to the inner surface of the side wall of the container.

8. A system comprising:

a container having an opening defined by a sidewall that has an inner surface and an outer surface;

a unitary liner ring, to secure a liner within the container, the liner ring further comprising a downward extending surface; and a sealant attached to the downward extending surface of the liner ring to form a seal with at least one of the inner surface and the outer surface of the container.

9. The system according to claim 8, wherein the liner ring comprises a top edge and wherein the downwardly extending surface extends to a bottom edge of the liner ring opposite to the top edge; and wherein the liner ring fits within the container so that the liner ring remains in place at a defined distance within the container based on a dimension of the container and a dimension of the liner ring.

10. The system according to claim 9, wherein the op edge has a first outer diameter, the downwardly extending surface has a second outer diameter less than the first outer diameter, and wherein the sealant attached to the downwardly extending surface has an outer diameter greater than the second outer diameter and less than the first outer diameter;

wherein the sealant is attached to an outer surface of the liner ring to form the seal with the inner surface of the container.

11. The system according to claim 8, wherein the liner ring fits around an outer circumference of the container.

12. The system according to claim 11, wherein the sealant is attached to an inner surface of the liner ring to form a seal with the outer surface of the container.

13. The system according to claim 8, wherein the sealant is fitted within a groove along an outer surface of the liner ring and wherein the sealant maintains the liner ring in place and to further secure a liner placed within container.

14. The system according to claim 9, wherein ends of an opening to the liner are secured within the container by the liner ring such that the ends being placed around the liner ring provides for the ends to the opening of the liner being located between the liner ring and container within the container when the liner ring is fit within the container so that the liner ring is not visible.

15. The system according to claim 14, wherein ends of the opening to the liner are secured within the container by the liner ring to provide for the liner having the ends of the opening wrapped over a top rim of the liner ring and around the liner ring towards the sealant so that the opening is secured within the container when the liner ring and liner are placed within the container.

16. The system according to claim 8, wherein the downward extending surface of the liner ring comprises at least one opening through the wall to provide for a release of trapped air between the container and the liner when the liner and liner ring are placed within the container.

17. The system according to claim 9, wherein the liner ring comprises a top edge that when the liner ring is within the container, the top edge is substantially parallel to a top edge of the container.

18. The apparatus of claim 8, wherein the sealant comprises a compression gasket.

* * * * *